US007618040B2

(12) United States Patent
Mahler et al.

(10) Patent No.: US 7,618,040 B2
(45) Date of Patent: Nov. 17, 2009

(54) GATHERING DEVICE

(75) Inventors: Erwin Mahler, Geuensee (CH); Thomas Mazur, Sursee (CH)

(73) Assignee: Hunkeler AG, Wikon (CH)

( * ) Notice: Subject to any disclaimer, the term of this patent is extended or adjusted under 35 U.S.C. 154(b) by 166 days.

(21) Appl. No.: 11/798,464

(22) Filed: May 14, 2007

(65) Prior Publication Data

US 2008/0048381 A1 Feb. 28, 2008

(30) Foreign Application Priority Data

May 15, 2006 (EP) ..... 06009925

(51) Int. Cl.
*B65H 39/00* (2006.01)

(52) U.S. Cl. ..... 271/314; 271/207; 270/60

(58) Field of Classification Search ..... 271/314, 271/275, 207; 270/60, 6, 7, 10, 11, 13, 14, 270/43, 44, 38, 47
See application file for complete search history.

(56) References Cited

U.S. PATENT DOCUMENTS

| | | | | |
|---|---|---|---|---|
| 3,172,657 | A * | 3/1965 | Brandt | 271/275 |
| 3,683,943 | A * | 8/1972 | De Crepy | 271/301 |
| 3,851,962 | A * | 12/1974 | Van Vloten | 399/316 |
| 4,822,018 | A * | 4/1989 | Hain | 271/3.2 |
| 5,121,170 | A * | 6/1992 | Bannai et al. | 399/303 |
| 5,735,516 | A * | 4/1998 | Gerlier et al. | 270/60 |
| 6,595,515 | B2 * | 7/2003 | Numata et al. | 271/193 |
| 7,328,899 | B2 * | 2/2008 | Wulf et al. | 271/276 |
| 2002/0074716 | A1 | 6/2002 | Allen et al. | |
| 2004/0212146 | A1 * | 10/2004 | Wulf et al. | 271/275 |

FOREIGN PATENT DOCUMENTS

| | | |
|---|---|---|
| DE | 620 892 | 11/1935 |
| DE | 763 627 | 10/1950 |
| DE | 28 40 915 A1 | 3/1980 |
| EP | 1 464 603 A1 | 10/2004 |
| EP | 1 471 022 A1 | 10/2004 |
| GB | 2 030 969 A | 4/1980 |

* cited by examiner

*Primary Examiner*—Kaitlin S Joerger
(74) *Attorney, Agent, or Firm*—Oliff & Berridge, PLC

(57) ABSTRACT

The invention concerns a gathering device (10) with a revolving body (14) for the formation of sheet stacks (34, 35) from individually delivered sheets (30, 31). Thanks to a device (23) for generating a holding force, preferably by electrostatic charging, which is arranged essentially outside the outer surface (16) of the revolving body (14), the sheets (30, 31) can be secured to the revolving body (14) without the revolving body (14) needing to have receiving positions dictated by mechanical means. Therefore, the receiving positions can be adapted as desired to the particular requirements.

22 Claims, 2 Drawing Sheets

GATHERING DEVICE

Figure 1:
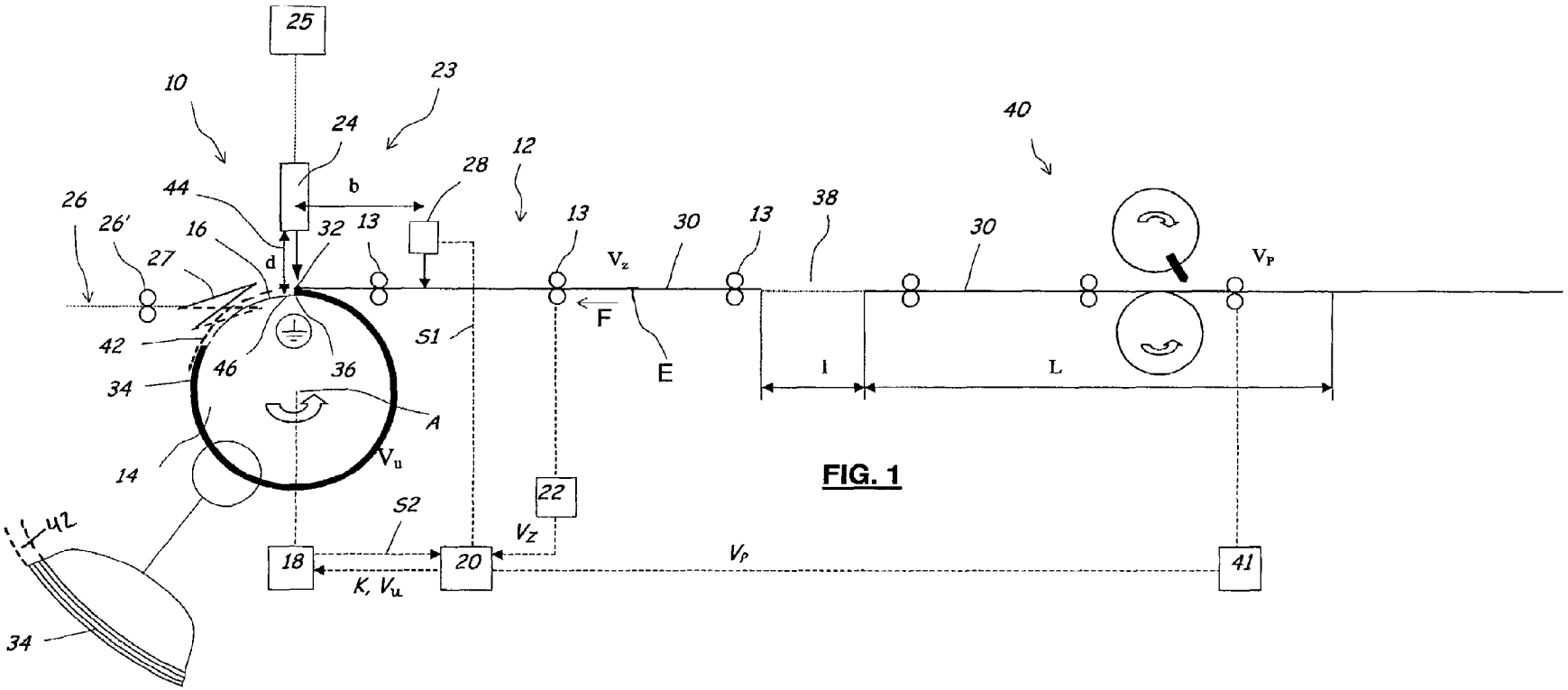

The present invention concerns a gathering device according to the preamble of claim 1.

Such gathering devices, which secure a plurality of supplied sheets one after the other on a rotating revolving body and thereby form a sheet stack, are known for example from EP-A 1 471 022, US-A 2002/0074716, DE 763 627 or DE 620 892. All gathering devices must on the one hand secure the sheets and on the other hand orient them register-true to each other. The known gathering devices have holding and end stop elements for this, which are arranged on the outer surface of the revolving body. The end stop elements form a mechanical end stop projecting radially outward from the outer surface, against which end stop the leading edge of a newly arriving sheet is oriented. The holding elements secure the sheet or sheets mechanically by a clamping action. In the gathering device per DE 763 627 or DE 620 892, two types of grippers are present, which carry out the end stop and holding functions. EP-A 1 471 022 uses only one type of grippers. The grippers, of identical construction, are divided into two groups, which alternate functionally as end stop and as holding elements.

Drawbacks to the known devices are the sheet receiving positions on the circumference of the revolving body, dictated by the mechanical end stop and holding elements. Because of these defined receiving positions, on the one hand, it is time-consuming to set up the gathering device, because a sheet has to be fed in such a way that its leading edge strikes the end stop. What is more, these gathering devices are not flexible, since they have only one predetermined receiving position. The reception of several sheets at different receiving positions and, thus, the simultaneous formation of several sheet stacks with rather short formats (multiple-sheet copies), the switching from single to multiple-sheet copies, or the reception of sheets in staggered fashion is not possible.

It is known how to hold together already finished paper stacks or paper webs already placed one on top of another by means of electrostatic charging, so that they can be further processed more easily, see, e.g., CH 659 035.

The problem on which the invention is based is to provide a gathering device which enables the gathering of sheets at receiving positions which have not previously been fixed and thus a flexible processing even for different formats.

The problem is solved by a gathering device with the features of claim 1, as well as by an operating method with the features of claim 9. Advantageous embodiments of the invention are shown in the dependent claims, the description, and the drawings.

The invented gathering device comprises, in familiar fashion, a feed device for sheets, a revolving body mounted and able to turn on an axis, a drive unit by which the revolving body can be displaced in rotation, and a device for generating a holding force to secure at least two sheets in the form of a sheet stack on the outer surface of the revolving body, as well as a control mechanism. Contrary to the prior art, the device for generating a holding force is not arranged on the revolving body, but instead comprises a device part arranged stationary at a distance from the revolving body and radially outside the outer surface of the revolving body. This creates a holding force which secures the sheet stack on the revolving body without any mechanical holding means moving along with the revolving body. The revolving body and the feed device are driven in synchronization so that the sheets are received register-true or with a predetermined offset. For this, the control mechanism is able to alter the rotation of the revolving body and/or the feed rate of the feed device so that the arriving sheet is secured flush with or at a predetermined distance from sheets which may already be secured, without any mechanical end stop means moving along with the revolving body. In this way, one or more sheet stacks can be formed on the outer surface of the revolving body, which sheet stacks can contain sheets in any desired arrangement relative to each other. Even two or more only partly overlapping sheets shall be designated hereafter as a "sheet stack".

The aforesaid device part for generating a holding force, contrary to the prior art, is not moved along with but instead arranged outside the revolving body. Besides the revolving body, which can take part in generating the holding force, there are only device parts at a radial distance from the outer surface. The holding force is not only punctually timed by holding elements grabbing the leading edge, but instead it is preferably exerted continuously and over a portion or the entire surface of the sheet. Thus, the holding force acting on a sheet, despite the device for generating it being arranged in a stationary fashion, is largely independent of the rotary position of the revolving body. Hence, there are no given receiving positions along the outer surface of the revolving body.

The following benefits are associated with this design:

- The circumference of the revolving body can be utilized flexibly for receiving sheets. For example, if the format length is less than half the circumference, several sheet stacks can be formed at the same time. The switching from single to multiple-sheet copies is possible without mechanical intervention. Only the control unit needs to be adjusted for this.
- It is possible to receive sheets of different format and orient them relative to each other in a flexible manner, e.g., orienting one sheet at the front edge and the next sheet at the back edge of a first sheet already laid down.
- There is less pointwise loading on the sheet, since the holding force is distributed over a portion or the entire sheet.
- Complicated timed actuation of holding means is eliminated.

The device for generating a holding force works mechanically, for example, having stationary support rollers or support bands arranged along the circumference of the revolving body, which continuously press a sheet or a sheet stack against the outer surface of the revolving body, which outer surface acts as an abutment.

Preferably, however, the holding force is based on electrostatic charging of the arriving sheets. In the case of electrostatic charging, the two surfaces of the sheet are provided with charges of opposite polarity. Thanks to the attraction of these charges, the sheets are secured together, one on top of the other, and to the outer surface of the revolving body. This is especially suitable for paper sheets or sheets made from another electrically insulating material. The charging can be accomplished by a pair of electrodes arranged above and below the level of the sheet in the region of the feed device. An especially good holding action results, however, when the revolving body, which is at least electrically conductive on its outer surface for this purpose, is used as the counterelectrode to an electrode situated outside of the revolving body, such as a point electrode, especially when it is grounded.

The drive unit of the feed device and the drive unit of the revolving body are preferably in a master-slave relationship with each other. The revolving body turns continuously and unregulated at a given speed until it receives a first sheet. The feeding of a sheet by means of the feed device is communicated to the control mechanism by means of a preferably optical detection mechanism, e.g., a light barrier. This detects the leading or trailing edge of a sheet or a register mark arranged on the sheet and relays a corresponding control signal to the control mechanism. The control mechanism, which can preferably detect continuously the rotary position of the revolving body, registers the rotary position at the time when the control signal arrives. From this, and from the known speed of rotation, the position of the first sheet when it is received on the revolving body is determined, e.g., the rotary position upon arrival of the leading edge at the outer surface of the revolving body. A corresponding quantity is saved in memory as the NOMINAL rotary position, which must be adopted again when another sheet arrives. Upon detecting an additional sheet by the detection mechanism, the rotary position of the revolving body is again registered and a correction quantity is determined, by means of which the speed of rotation is adjusted so that the rotary position upon receiving the additional sheet, e.g., upon arrival of the leading edge at the outer surface, corresponds to the NOMINAL rotary position.

The roles of the two drive units can, in theory, also be exchanged, i.e., the revolving body (master) can be driven at given speed and the feed device (slave) regulated afterward.

Instead of a detection mechanism generating a control signal, which informs the control mechanism of the arrival of a sheet, one can also use a trigger signal of an upstream unit, such as a printer or a cutting device. If a fixed relation exists between the time of this trigger signal and the time of reception on the revolving body, one can also determine the NOMINAL rotary position from such a trigger signal.

The invented gathering device can be used to particular advantage in conjunction with the production of digital "on demand" newspapers, i.e., those with extremely small print run. In this case, the sheets belonging to a newspaper are printed in series with a digital printing machine. A first newspaper with a first format is often followed by a second newspaper with a differing format. The newspapers can also contain "half" sheets or inserts in an additional format. The gathering device enables a nearly instantaneous, purely logical switching between different format lengths from one newspaper to another or within the same newspaper.

Figure 2:
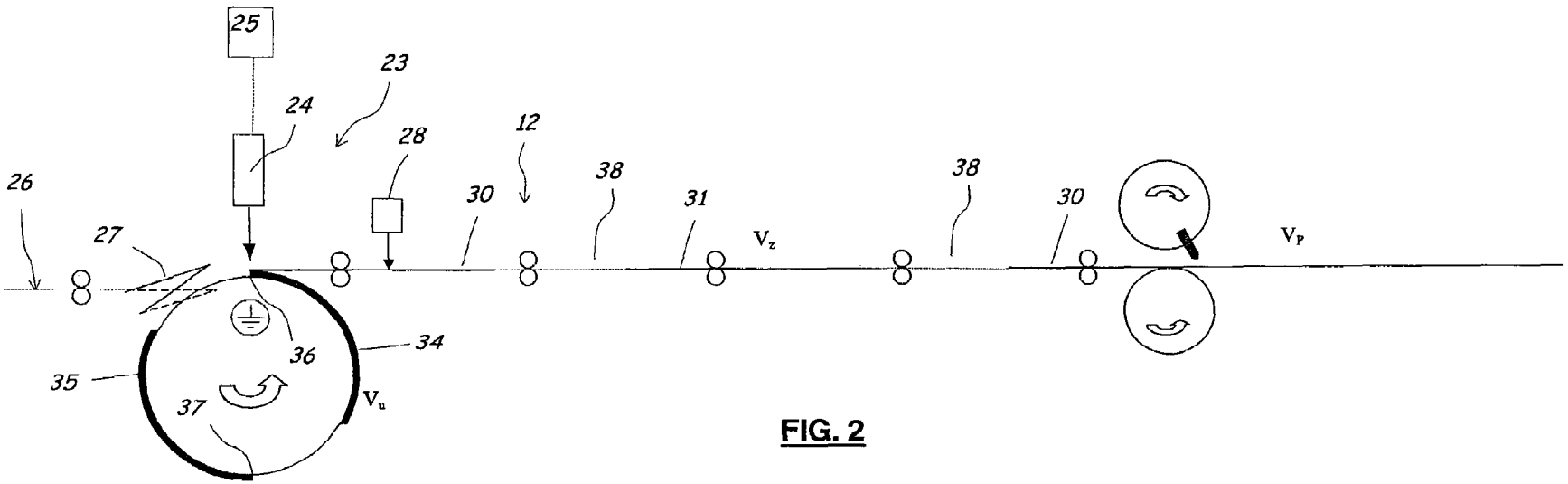

An example of an invented gathering device is presented in the drawings and described hereafter. These show, purely schematically:

FIG. 1, a gathering device and an upstream cross-cutting device, gathering a sheet stack on the circumference of the revolving body;

FIG. 2, the gathering device from FIG. 1, gathering two sheet stacks in each case on the circumference of the revolving body.

The invented gathering device 10 comprises a feed device 12 and a revolving body 14 in the shape of a cylinder or a drum, which can turn about an axis A. FIG. 1 shows the formation of a sheet stack 34 from single sheets 30 (single-sheet copies), while FIG. 2 shows the simultaneous formation of two sheet stacks 34, 35 from sheets 30, 31 (multiple-sheet copies). The gathering device 10 has the same configuration in both instances, but in FIG. 2 for reasons of clarity certain elements have been omitted.

The makeup of the gathering device 10 shall be described hereafter:

The feed device 12 in the present instance comprises a plurality of pairs of delivery rollers 13, which are moved with a drive unit 22, in order to move an arriving sheet 30, 31 with a feed rate $v_z$ in a (here) horizontal feed plane E in the delivery direction F to the revolving body 14. The feed plane E here runs tangentially to the cylinder envelope or to the outer surface 16 of the revolving body 14, but a curved feeding is also conceivable. The receiving region 46 is that region in which the feed plane E encounters the outer surface 16 of the revolving body 14 or at least comes close to it, here, the region about the uppermost point of the revolving body 14.

Another drive unit 18 is provided to place the revolving body 14 in rotation. The circumferential velocity $v_u$ at the outer surface 16 of the revolving body 14 is, in the present case, roughly equal to the feed rate $v_z$ within the bounds of the regulating range.

The outer surface 16 of the revolving body 14 according to the invention has no mechanical elements projecting radially outward. Thus, there is no mechanical element arranged on the revolving body 14 within that region of space 42 passed over by a sheet 30, 31 or sheet stack 34, 35 lying against the outer surface 16 during the rotation of the revolving body 14. This region of space 42 has the shape of a cylinder with an annular base surface. By outer surface 16 is meant that surface against which the sheet 30, 31 or sheet stack 34, 35 lies when the system is working. It can also be interrupted, e.g., consist of several segments.

A device 23 for generating a holding force comprises in the present case an electrode or arrangement of electrodes 24, arranged radially outside the revolving body 14. This is located at a distance d above the revolving body 14. Between revolving body 14 and the electrode 24, a delivery gap 44 is formed. The distance d is around 20 to 40 mm.

The electrode 24 is constantly hooked up to a high-voltage source 25, while the revolving body 14 is grounded and acts as a counterelectrode. There is a d.c. voltage of around 10 to 30 kV on it. Preferably, a point electrode device is used, having several individual electrodes emerging as sharp points which are arranged transversely to the delivery direction F.

In the delivery direction F in front of the revolving body 14 there is a detection mechanism 28 to sense the leading edge 32 of a sheet or other features of the sheet, e.g., printed register marks. The detection mechanism is preferably an optical sensor, e.g., a light barrier.

For the exiting of a sheet stack 34, 35, there is a mechanical shunt 27, which can be introduced from the outside into the above-described region of space 42 in order to peel the sheet stack 34, 35 from the outer surface 16 of the revolving body 14. The inactive position of the shunt 27 is shown by solid lines in the present case, the active position by broken lines. To carry away the sheet stack 34, 35, there is a carry-away device 26, which is outfitted with pairs of driven delivery rollers 26' analogous to the feed device, for example. As an alternative, the shunt can also be arranged preferably in a stationary fashion within the outer surface 16 so that it can enter the region of space 42 from the inside and lift off the sheet stack 34, 35, whereupon it is taken over by the carry-away device 26.

A control mechanism 20 controls the drive units 18, 22 of the revolving body 14 and feed device 12 and receives signals S1, S2 from the detection mechanism 28 and from the drive unit 18 of the revolving body 14.

The gathering device 10 is placed in front of an upstream module 40 through which the sheets 30, 31 or the still undivided material web are delivered at a rate $v_p$ to the feed device 12. A drive unit 41 is likewise provided. The upstream module 40 here is a cross-cutting device, which separates a continuous material web into individual sheets 30, 31.

The gathering device 10 works as follows:

The sheets. 30, 31 are delivered in the feed device 12 at a feed rate $v_z$. For this, the control mechanism 20 sends a corresponding control signal to the drive unit 22. The control mechanism 20 also sets the circumferential velocity $v_u$ of the revolving body 14 by a corresponding control signal to the drive unit 18. The circumferential velocity $v_u$ corresponds to the feed rate $v_z$.

In order to make a gap 38 between the sheets 30, 31 delivered seamlessly or even as a continuous web in the upstream module 40, the feed rate $v_z$ is larger than the speed $v_p$ in the upstream module 40 by the ratio of the gap length 1 to the sheet length L. The gap length 1 chosen is thus adapted to the sheet length L, so that sheet length L plus gap length 1 corresponds to the circumference of the revolving body 14 (FIG. 1). When gathering multiple-sheet copies (FIG. 2), the sum of n sheets plus n gaps corresponds to the revolving body's circumference. The thus calculated speed ratio of $v_z$ to $v_p$ is electronically set via the control mechanism 20, with the upstream module 40 assigning the speed $v_p$. A corresponding feed signal is digitally relayed to the control mechanism 20. The drive unit 41 of the upstream module 40 and the drive unit 22 of the feed device 12 are therefore coupled together via an electronic gearing so that the transmission ratio is variable. If sheets of different length L are being gathered into a common stack 34, 35, the feed rate $v_z$ and thus also the circumferential velocity $v_u$ will change during the gathering process. For example, after a sheet 30, 31 with shorter sheet length L it is necessary to create a larger gap 38 by increasing $v_z$ and $v_u$ so that the leading edge 32 of a following sheet will again lie register-true on the stack 34, 35. For this, the control mechanism 20 evaluates trigger signals from the upstream module 40, thereby indicating the sheet length L and the cutting processes.

The revolving body 14 is driven continuously, without regulation, until a first sheet 30 is received. As soon as the leading edge 32 of a first sheet 30 delivered by the feed device 12 is detected by the detection mechanism 28, the detection mechanism 28 sends a signal S1 to the control mechanism 20. The sheet 30, meanwhile, is carried onward and encounters the revolving body 14 in the receiving region 46. In this region, the electrode 24 is also situated in the present case. With the electrode, at first the leading edge 32 and then as the revolving body 14 continues to turn the entire sheet 30 is electrostatically charged and thus secured against the revolving body 14. The rotary position when receiving a first sheet 30 is arbitrary, since there are no receiving positions dictated by mechanical elements. To synchronize the following sheets 30, the control mechanism 20 is able to ascertain the rotary position when receiving a first sheet or a quantity proportional to that, to save it in memory as a NOMINAL rotary position, and to influence the drive units 18 and 22 in such a way that the NOMINAL rotary position is also adopted again upon arrival of another sheet 30. Thus, the control mechanism 20 acts as a position governor for the revolving body 14.

For this, the control mechanism 20 receives signals S2 from the drive unit 18 of the revolving body 14 continuously or on demand, and the instantaneous rotary position can be deduced from them in terms of a predetermined reference position. From the signal S2 that was relayed or retrieved at the time of arrival of the signal S1, the control mechanism 20 can determine the rotary position of the revolving body 14 when the leading edge 32 impinges on the revolving body 14 or when the leading edge 32 enters the receiving region 46. This is possible, since the circumferential velocity $v_u$ or frequency of rotation of the revolving body 14, the feed rate $v_z$, and the distance b of the detection mechanism 28 from the receiving region 46 are known.

The rotary position upon contact of a first sheet as determined in this way, or a signal directly related to it, is saved in memory by the control mechanism as a NOMINAL rotary position.

Upon sensing the leading edge 32 of another sheet 30, the detection mechanism 28 likewise relays a signal S1 to the control mechanism 20 and the current rotary position is determined by the drive unit 18 per signal S2. From this, it is possible to determine the uncorrected rotary position for the anticipated impinging of the leading edge 32 on the revolving body 14 (ACTUAL rotary position). By comparing the ACTUAL rotary position with the NOMINAL rotary position, a correction quantity K is ascertained and transmitted to the drive unit. This correction quantity K indicates the amount by which the circumferential or angular velocity of the revolving body 14 needs to be changed in order to correct the position error by the time that the leading edge 32 reaches the receiving region 46. Thus, the leading edge 32 of the sheet 30 is placed flush with the leading edge 36 of the stack 34.

In order to make a sheet stack 34 per FIG. 1, the first sheet 30 is electrostatically secured on the revolving body 14 and the following sheets 30 are each secured on the preceding sheet 30. Since the revolving body 14 acts as a counterelectrode, the electrostatic charging is refreshed at each revolution. It has been found that, with field strengths of 0.7 to 6.0 kV/m in the receiving region 46, sheet stacks 34, 35 of 2 to 24 paper sheets (with at most 40-65 g/m$^2$) can be secured with no problem. In theory, instead of the electrode 24, one could also arrange a pair of electrodes further upstream in the region of the feed device 12. In this case, the sheets 30 would arrive at the revolving body 14 already charged.

The complete stack 34 is peeled off from the revolving body 14 by means of the shunt 27 which is switched into the gap, and fed to a downstream module 26. The last sheet 30 of the stack 34 is fed and at the same time transported away with the finished stack 34.

In the case of multiple-sheet copies per FIG. 2, shorter sheets 30, 31 are produced, being alternately assigned in each case to one of the two stacks 34, 35. The control mechanism 20 determines several (here, two) NOMINAL rotary positions and corrects the motion of the revolving body 14 accordingly, so that the sheets 30, 31 are received flush with the leading edge 36, 37 of the stack 34, 35.

Furthermore, it is possible to adjust the NOMINAL rotary position from one sheet to another, by computer; for example, in order to variably synchronize another sheet to the trailing edge or the middle of an already received sheet.

The invention claimed is:

1. A gathering device for collating sheets, especially printed paper sheets, to form a sheet stack, comprising:

a revolving body having an outer surface and being mounted to rotate about an axis, a drive unit for rotatably driving the revolving body, a feed device for feeding sheets to the revolving body at a feed rate, a device for generating a holding force to secure sheet stacks consisting of at least two sheets on the outer surface of the revolving body, said device for generating a holding force comprising an electrode arrangement having at least one electrode, and a voltage source connected to the electrode arrangement, said voltage source electrostatically charging an arriving sheet for generating a holding force fixing a sheet stack on the revolving body, a control mechanism which continuously detects the rotary position of the revolving body and which is able to alter the rotation of the revolving body so that an arriving sheet is secured flush with or at a predetermined distance from sheets already secured, a detection mechanism connected to the control mechanism for detecting the position of the sheets fed to the revolving body, said detection mechanism detecting a leading or trailing edge of a sheet to be received and/or a register mark arranged on the sheet and transmitting a corresponding signal to the control mechanism, wherein the control mechanism determines, in dependence on a first signal of the detection mechanism concerning a first arriving sheet and a second signal corresponding to the momentary rotary position of the revolving body, a NOMINAL rotary position of the revolving body, and further determines a correction value in dependence on a third signal of the detection mechanism concerning an additional arriving sheet, a substantially simultaneously detected second signal, and the previously determined NOMINAL rotary position, the control mechanism based on said correction value acting on the drive unit for the revolving body and/or the feed device in such a way that the revolving body takes up the NOMINAL rotary position when receiving the additional sheet.

2. The gathering device as claimed in claim 1, wherein the revolving body has an outer surface in the form of a closed or interrupted cylinder envelope with no elements projecting radially outward from the revolving body.

3. The gathering device as claimed in claim 1, wherein the electrode arrangement is arranged at a distance from the revolving body and radially outside the outer surface of the revolving body.

4. The gathering device as claimed in claim 3, wherein the revolving body acts as a counterelectrode.

5. The gathering device as claimed in claim 3, wherein at least the outer surface of the revolving body is electrically conductive.

6. The gathering device as claimed in claim 3, wherein the revolving body is grounded.

7. The gathering device as claimed in claim 3, wherein the electric field strength at the outer surface of the revolving body in the region of the electrode arrangement is at least 0.6 V/m.

8. The gathering device as claimed in claim 7, wherein the electric field strength at the outer surface of the revolving body in the region of the electrode arrangement is between 0.6 and 7.0 kV/m.

9. A method for operating a gathering device as claimed in claim 1, wherein the electrode arrangement and the voltage source of the device for generating a holding force are operated continuously;

the revolving body and the feed device are driven continuously; and the control mechanism actuates the drive unit of the revolving body and the feed device in a coordinated manner, so that an arriving sheet is secured flush with or at a predetermined distance from sheets already secured.

10. The method as claimed in claim 9, wherein the feed device is driven at a given speed and the revolving body is driven at a speed which is adapted to said given speed of the feed device but is able to vary within given ranges.

11. The gathering device as claimed in claim 1, wherein the control mechanism which continuously detects the rotary position of the revolving body is additionally able to alter the feed rate of the feed device so that an arriving sheet is secured flush with or at a predetermined distance from sheets already secured.

12. The gathering device for collating sheets, especially printed paper sheets, to form a sheet stack, further comprising:

a revolving body having an outer surface and being mounted to rotate about an axis, a drive unit for rotatably driving the revolving body, a feed device for feeding sheets to the revolving body at a feed rate, a device for generating a holding force to secure sheet stacks consisting of at least two sheets on the outer surface of the revolving body, said device for generating a holding force comprising an electrode arrangement having at least one electrode, and a voltage source connected to the electrode arrangement, said voltage source electrostatically charging an arriving sheet for generating a holding force fixing a sheet stack on the revolving body, a control mechanism which continuously detects the rotary position of the revolving body and which is able to alter the feed rate of the feed device so that an arriving sheet is secured flush with or at a predetermined distance from sheets already secured, a detection mechanism connected to the control mechanism for detecting the position of the sheets fed to the revolving body, said detection mechanism detecting a leading or trailing edge of a sheet to be received and/or a register mark arranged on the sheet and transmitting a corresponding signal to the control mechanism, wherein the control mechanism determines, in dependence on a first signal of the detection mechanism concerning a first arriving sheet and a second signal corresponding to the momentary rotary position of the revolving body, a NOMINAL rotary position of the revolving body, and further determines a correction value in dependence on a third signal of the detection mechanism concerning an additional arriving sheet, a substantially simultaneously detected second signal, and the previously determined NOMINAL rotary position, the control mechanism based on said correction value acting on the drive unit for the revolving body and/or the feed device in such a way that the revolving body takes up the NOMINAL rotary position when receiving the additional sheet.

13. The gathering device as claimed in claim 12, wherein the revolving body has an outer surface in the form of a closed or interrupted cylinder envelope with no elements projecting radially outward from the revolving body.

14. The gathering device as claimed in claim 12, wherein the electrode arrangement is arranged at a distance from the revolving body and radially outside the outer surface of the revolving body.

15. The gathering device as claimed in claim 14, wherein the revolving body acts as a counterelectrode.

16. The gathering device as claimed in claim 3, wherein at least the outer surface of the revolving body is electrically conductive.

17. The gathering device as claimed in claim 14, wherein the revolving body is grounded.

18. The gathering device as claimed in claim 14, wherein the electric field strength at the outer surface of the revolving body in the region of the electrode arrangement is at least 0.6 V/m.

19. The gathering device as claimed in claim 8, wherein the electric field strength at the outer surface of the revolving body in the region of the electrode arrangement is between 0.6 and 7.0 kV/m.

20. A method for operating a gathering device as claimed in claim 12, wherein the electrode arrangement and the voltage source of the device for generating a holding force are operated continuously;

the revolving body and the feed device are driven continuously; and the control mechanism actuates the drive unit of the revolving body and the feed device in a coordinated manner, so that an arriving sheet is secured flush with or at a predetermined distance from sheets already secured.

21. The method as claimed in claim 20, wherein the feed device is driven at a given speed and the revolving body is driven at a speed which is adapted to said given speed of the feed device but is able to vary within given ranges.

22. The gathering device as claimed in claim 12, wherein the control mechanism which continuously detects the rotary position of the revolving body is additionally able to alter the rotation of the revolving body so that an arriving sheet is secured flush with or at a predetermined distance from sheets already secured.

* * * * *